United States Patent [19]

Burd

[11] Patent Number: 4,516,801

[45] Date of Patent: May 14, 1985

[54] POD LIFTING ADAPTOR

[76] Inventor: David E. Burd, 5968 Albrecht Ave., Marysville, Calif. 95901

[21] Appl. No.: 562,264

[22] Filed: Dec. 16, 1983

[51] Int. Cl.[3] ..... B66C 1/66

[52] U.S. Cl. ..... 294/81.5; 294/67.1; 294/81.1

[58] Field of Search ..... 294/67 R, 67 A, 67 AA, 294/67 AB, 67 B, 67 DA, 67 DB, 78 A, 81 R, 82 AH, 86 LS

[56] References Cited

U.S. PATENT DOCUMENTS

| | | | |
|---|---|---|---|
| 1,852,758 | 4/1932 | Schroeder | 294/67 R |
| 2,349,717 | 5/1944 | Graham | 294/78 A |
| 3,438,160 | 4/1969 | Gostling | 294/67 R X |
| 3,517,959 | 6/1970 | Ferguson | 294/67 R |
| 3,762,756 | 10/1973 | Cole | 294/81 R |
| 4,431,223 | 2/1984 | Miller | 294/78 A X |

FOREIGN PATENT DOCUMENTS

| | | | |
|---|---|---|---|
| 1015344 | 9/1952 | France | 294/67 A |
| 148622 | 6/1981 | German Democratic Rep. | 294/81 R |
| 581077 | 11/1977 | U.S.S.R. | 294/81 R |

*Primary Examiner*—Johnny D. Cherry

*Attorney, Agent, or Firm*—Donald J. Singer; Bobby D. Scearce

[57] ABSTRACT

A novel lifting adaptor is described for lifting an elongate load having a pair of lifting brackets attached thereto, which comprises a beam having a connector at one end for attaching a hoist, a narrow tongue at the other end for insertion into one of the lifting brackets, and a lifting hook attached to the beam intermediate the tongue and connector for engaging the other lifting bracket, the tongue disposed obliquely to the remainder of the beam and in substantial alignment with the lifting hook so that both lifting brackets are engaged simultaneously, the beam sized to define a lifting point above the center of gravity of the load.

1 Claim, 2 Drawing Figures

POD LIFTING ADAPTOR

RIGHTS OF THE GOVERNMENT

The invention described herein may be manufactured and used by or for the Government of the United States for all governmental purposes without the payment of any royalty.

BACKGROUND OF THE INVENTION

The present invention relates generally to lever or beam type adaptors for use with load hoisting equipment, and more particularly to an improved lever type hoisting adaptor for handling elongate external stores for an aircraft.

The ground handling of stores preparatory to installation onto an aircraft is often complicated by the unwieldiness and the weight, bulk and shape of the stores. The lugs or lifting brackets provided on these stores, by design or otherwise, are often not disposed conveniently with respect to the center of gravity of the stores to facilitate lifting and moving thereof. Since these stores may weigh upwards of several hundred pounds, a substantial safety hazard is presented in attempting to handle the stores in an unbalanced configuration.

The present invention alleviates or substantially reduces in critical importance the problem of balanced ground handling of stores for aircraft. Specifically, the present invention provides a reliable, low cost lifting adaptor in the form of an elongate beam or lever for use in handling cigar shaped devices for aircraft such as the ECM pods. The adaptor includes a clevis fitting at one end for engagement with a hoist line, a narrow tongue at the other end for insertion into one lifting bracket on the pod, and a clevis and hook intermediate the two ends for engagement with the other lifting bracket on the pod. The adaptor is sized so that the hoist line lifts the pod along a vertical line passing through or very near the center of gravity of the load, so that the pod may be lifted in a balanced configuration.

It is, therefore, a principal object of the present invention to provide an improved lever type adaptor for hoisting heavy loads.

It is a further object of the invention to provide a lever type hoisting adaptor for use in handling elongated stores for aircraft.

These and other objects of the present invention will become apparent as the detailed description of certain representative embodiments thereof proceeds.

SUMMARY OF THE INVENTION

In accordance with the foregoing principles and objects of the present invention, a novel lifting adaptor is described for lifting an elongate load having a pair of lifting brackets attached thereto, which comprises a beam having a connector at one end for attaching a hoist, a narrow tongue at the other end for insertion into one of the lifting brackets, and a lifting hook attached to the beam intermediate the tongue and connector for engaging the other lifting bracket, the tongue disposed obliquely to the remainder of the beam and in substantial alignment with the lifting hook so that both lifting brackets are engaged simultaneously, the beam sized to define a lifting point above the center of gravity of the load.

DESCRIPTION OF THE DRAWINGS

The present invention will be more clearly understood from the following detailed description of representative embodiments thereof read in conjunction with the accompanying drawings wherein.

DETAILED DESCRIPTION

Figure 1:
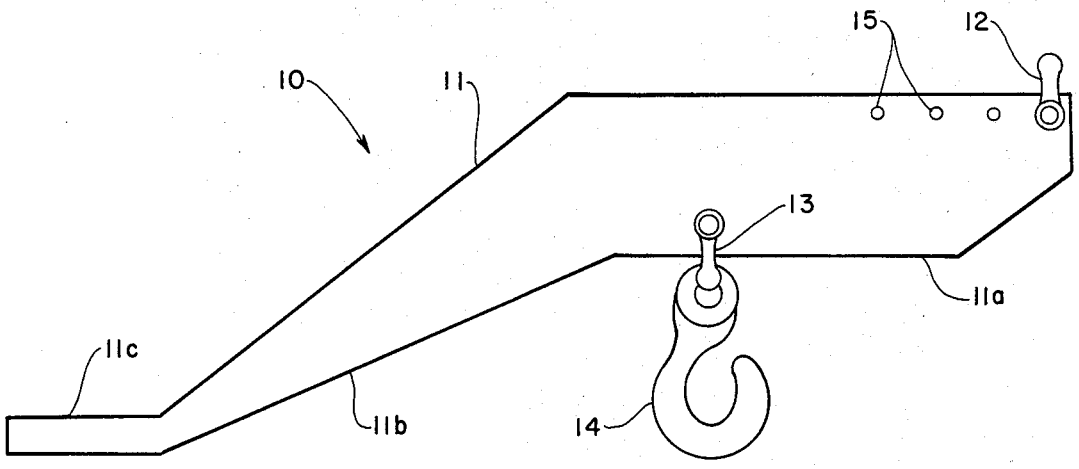
FIG. 1 is a side elevational view, substantially to scale of one representative embodiment of the lifting adaptor of the present invention.

Referring now to the drawings, FIG. 1 shows an elevational view, substantially to scale, of an embodiment of the lifting adaptor of the present invention. As illustrated in FIG. 1, adaptor 10 may comprise a lever or beam 11 of unusual shape, substantially as shown, having a first section 11*a* at a first end thereof, an intermediate section 11*b* disposed obliquely to section 11*a*, and a third portion in the form of a narrow tongue 11*c* at the second end of beam 11 disposed obliquely to the intermediate section 11*b* of beam 11 and substantially parallel to section 11*a* as shown. More generally, beam 11 may comprise a single beam section terminating at one end with a tongue 11*c* disposed obliquely at a predetermined angle to the remainder of the beam 11. In the embodiment of adaptor 10 depicted in the drawings, beam 11 was a single piece of one-half inch flat steel plate stock having intermediate section 11*b* tapered for enhanced strength. Section 11*a* included a pair of spaced holes for receiving a pair of connectors in the form of clevises 12, 13. Clevis 12 was located in the extreme upper edge of section 11*a* near the end thereof for receiving a lifting hook and chain hoist as hereinafter described. Clevis 13 was located near the lower edge of section 11*a*, between clevis 12 and intermediate section 11*b*, for receiving a safety hook 14 for engaging a mounting lug on the pod or other store being handled.

In a representative model of the adaptor 10 built in demonstration of the present invention, the overall length of lever 11 was about 28 inches and the overall width was about 10 inches, tongue 11*c* was about $\frac{7}{8}$ inch wide by about 4 inches long, and the horizontal section 11*a* was about 4 inches wide by about 13 inches long with clevis 13 and hook 14 located about 9 inches from clevis 12. Clevises 12, 13 and hook 14 were rated at about $\frac{3}{4}$ ton in order for adaptor 10 to accommodate stores weighing up to about 1,000 pound with a substantial safety margin. The foregoing dimensions are representative only and are not presented by way of limitation of the invention herein, as the demonstration adaptor 10 depicted in the drawings was configured specifically for the ECM 119 pod configuration for a specific aircraft, the said pod having a pair of lifting brackets located on the surface of the pod approximately 9 and 23 inches aft of the center of gravity of the pod.

Figure 2:
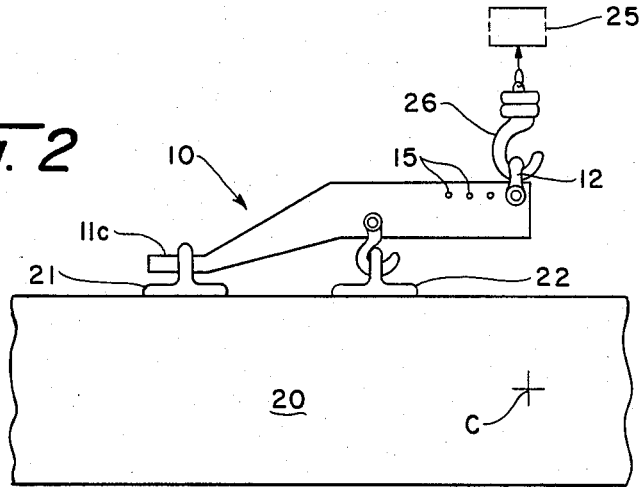
FIG. 2 is a side elevational view of the lifting adaptor of FIG. 1 illustrating attachment to a pod for lifting and moving thereof.

Referring now to FIG. 2, illustrated therein is the attachment of an adaptor 10 of the present invention to a pod 20 for lifting and moving thereof. As shown therein, adaptor 10 may interconnect with the lifting brackets 21, 22 on the aft end of pod 20 substantially as shown. As discussed previously, lifting brackets 21, 22 on the aft end of pod 20 are often positioned away from a convenient line through the center of gravity C of pod 20. Therefore, adaptor 10 may be sized to conveniently interconnect with the lifting brackets 21, 22 substantially as shown with the lifting point at clevis 12 substantially along a line through the center of gravity C of pod 20. To ensure a lifting point above the center of gravity C, additional holes 15 may be included near the top edge of beam 11, substantially as shown, to receive clevis 12. In order to accomplish this, tongue 11*c* is sized to fit snugly into aft lifting bracket 21, and clevis 13 and hook 14 are positioned along section 11*a* to engage bracket 22 as shown. The degree of obliquity (selection of angle) of section 11*c* with section 11*b* of beam 11 is selected to provide that tongue 11*c* is in substantial alignment with hook 14 for attachment of adaptor 10 with both lifting brackets 21, 22 simultaneously. Conventional lifting means, including chain hoist 25 attached to hook 26 may then be utilized to attach to clevis 12 for balanced lifting of pod 20 along a vertical line passing substantially through the center of gravity C of pod 20 as shown. A potentially extremely hazardous situation associated with lifting and moving of pod 20 in an unbalanced configuration is thereby removed.

The present invention, as hereinabove described, therefore provides a novel lifting adaptor for safe ground handling of certain external stores for aircraft in the form of cigar shaped pods. It is understood that the invention as described may be alternatively configured and used, as might occur to one with skill in the field of this invention, within the scope of the appended claims. Therefore, all embodiments contemplated hereunder have not been shown in complete detail. Other embodiments may be developed without departing from the spirit of the invention or from the scope of the appended claims.

I claim:

1. A lifting adaptor for use in lifting and moving an elongate load having a pair of spaced lifting brackets attached thereto, comprising:

a. a beam having a substantially horizontal first portion and a second portion attached at a predetermined angle to said first portion at respective first ends thereof;

b. connector means near the second end of said first beam portion for removeably attaching a hoist;

c. the second end of said second beam portion terminating in a narrow tongue of predetermined size for insertion into a first of said lifting brackets, said tongue disposed substantially parallel to said first beam portion at;

d. a lifting hook attached to said first beam portion intermediate said connector means and said tongue for engaging the second of said lifting brackets, said hook disposed in substantial alignment with said tongue whereby said tongue and said lifting hook engage both said lifting brackets simultaneously; and e. said first beam portion sized to define a lifting point at said connector means near said second end of said first beam portion, said point lying on a vertical line passing near the center of gravity of said load.

* * * * *

UNITED STATES PATENT AND TRADEMARK OFFICE

CERTIFICATE OF CORRECTION

PATENT NO. : 4,516,801

DATED : May 14, 1985

INVENTOR(S) : David E. Burd

It is certified that error appears in the above—identified patent and that said Letters Patent is hereby corrected as shown below:

Col. 4, line 17, within claim 1, paragraph c., fifth line, delete "at".

Signed and Sealed this

*Twenty-fourth* Day of *September 1985*

[SEAL]

*Attest:*

DONALD J. QUIGG

*Attesting Officer*

*Commissioner of Patents and Trademarks—Designate*